United States Patent [19]

Marzoli

[11] 4,133,073

[45] Jan. 9, 1979

[54] CLEANING DEVICE FOR THE SCRAPER BLADES ASSOCIATED WITH ROTATING SEPARATION AND/OR CLEARING ROLLERS FOR A TEXTILE FIBRE WEB IN SPINNING MACHINES

[75] Inventor: Angelo Marzoli, Bergamo, Italy

[73] Assignee: F.lli Marzoli & C. S.p.A., Brescia, Italy

[21] Appl. No.: 786,676

[22] Filed: Apr. 11, 1977

[30] Foreign Application Priority Data

Apr. 14, 1976 [IT] Italy ..... 22323 A/76

[51] Int. Cl.[2] ..... D01H 11/00

[52] U.S. Cl. ..... 15/308; 15/256.51; 19/263

[58] Field of Search ..... 15/93 R, 256.51, 256.53, 15/301, 308; 19/107; 57/56

[56] References Cited

U.S. PATENT DOCUMENTS

| | | | |
|---|---|---|---|
| 3,526,017 | 9/1970 | Kleimola | 15/256.51 X |
| 3,688,337 | 9/1972 | Noda | 15/256.53 |
| 3,740,789 | 6/1973 | Ticknor | 15/256.53 |
| 3,781,107 | 12/1973 | Ruhland | 15/256.53 X |
| 3,917,398 | 11/1975 | Takahashi et al. | 15/256.51 X |

*Primary Examiner*—Christopher K. Moore
*Attorney, Agent, or Firm*—Haseltine, Lake & Waters

[57] ABSTRACT

A cleaning device is disclosed for the scraper blades of a clearing roller in a spinning machine such as a card, the improvement consisting in that there is a cleaning element for each of such blades, the cleaning element resting on such blade, control means being also provided for impressing a reciprocation to said cleaning elements in sliding contact with the blades, suction means being provided in front of the roller and blade ends.

5 Claims, 4 Drawing Figures

CLEANING DEVICE FOR THE SCRAPER BLADES ASSOCIATED WITH ROTATING SEPARATION AND/OR CLEARING ROLLERS FOR A TEXTILE FIBRE WEB IN SPINNING MACHINES

This invention relates to a cleaning device for the scraper blades associated with the rotating cylinders which in spinning machines, such as cards, are required to separate and/or clear the fibre and in particular cotton web.

The pairs of rotating cylinders which in cards remove the fibre web from the doffer or, when subjected to a determined pressure clear the fibre web, are normally provided with scraper blades which, when urged into contact with the surface of each cylinder by suitable means, such as counter-weighted levers or springs, remove from them the impurities and/or fibres which tend to attach themselves to the surface of said cylinders. In this manner, the cylinder surface is kept free of impurities and fibres which, returning to the web, could lead to variations in the thickness of the web and the subsequent sliver, so worsening the quality of this latter and the final product.

However after a short time said scraper blades become clogged with impurities and/or fibres and therefore require frequent repeated cleaning to prevent the impurities collected by them from returning to the web, giving rise to the danger of breaking it. This frequent repeated cleaning of the scraper blades has up to the present time been carried out by the personnel supervising the machines, with considerable wastage of labour and without obviating the danger of the impurities returning to the web.

The object of the invention is therefore to provide an automatic cleaning device for said scraper blades which not only eliminates the manual work, but gives greater guarantee against the undesirable return of impurities to the web.

To this end, the invention provides a cleaning device for the scraper blades, comprising for each blade a cleaning element resting on the blade, control means to give said cleaning elements a linear to-and-fro movement in sliding contact with the blades over their entire length, and suction means disposed in front of the blade ends and designed to remove the impurities and/or fibres collected by said blade cleaning elements during the to-and-fro movement.

Preferably the cleaning elements comprise pads of elastomer material resting on the scraper blades which do not lead to wear of the blades during the to-and-fro movement, and which by sliding in contact with the blades collect the impurities and/or fibres to push them towards the ends where they are removed by the suction means.

In this manner the blades are constantly kept clean and the impurities and fibres do not have sufficient time to clog the blades, because of which the danger that they return to the web and prejudice its quality is practically eliminated.

Further characteristics and advantages of the invention will be evident from the description given hereinafter of one embodiment, shown in the accompanying drawing in which.

Figure 4:
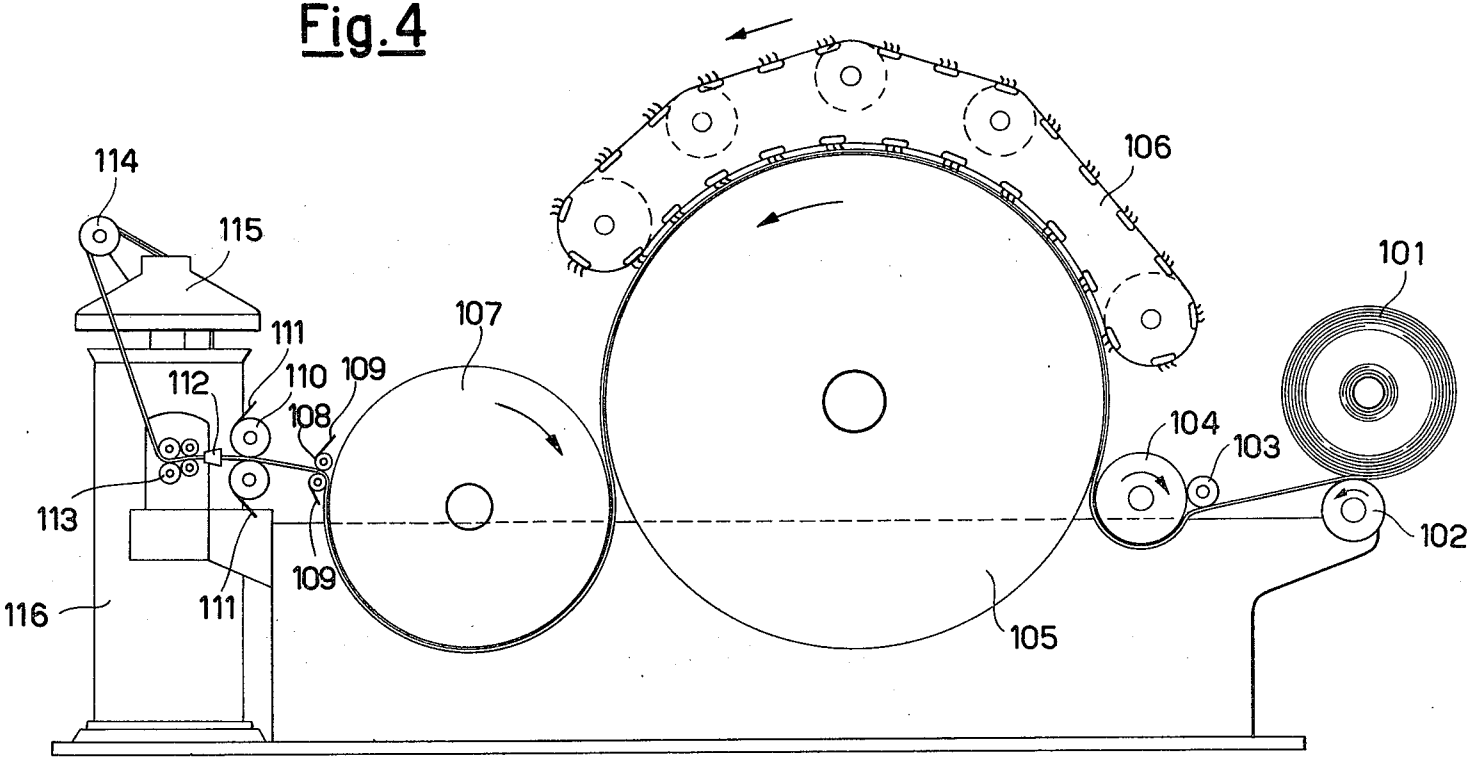
FIG. 4 is a diagrammatic illustration of a card with pairs of separation and clearing rollers to which the cleaning device according to the invention may be applied.

FIG. 4 is a diagrammatic illustration of a card of known type. The wad or lap 101 is unwound by direct contact with an unwinding roller 102 and fed to a feed roller 103 which passes it to the insertion roller 104 rotating faster than the roller 103. From the insertion roller 104 the fibres are carried on the carding roller or drum 105 which carries out the carding together with the mobile flats 106. Subsequently the fibres pass to the doffer 107 which rotates slowly, and from here they are removed and condensed in the form of a very thin web by a pair of separation cylinders 108. The web then passes through a pair of clearing cylinders 110 to a circular trumpet 112 which transforms it into a sliver. This sliver is drawn in a drawing unit 113 and from here it arrives above a return roller which feeds it to a distributor 115 which deposits it in a collection box 116.

Both the web separation rollers 108 and clearing rollers 110 are provided with scraper blades 109 and 111 respectively, and the cleaning device according to the invention is designed for application to these blades.

In the description given hereinafter, the cleaning device is considered applied to the scraper blades associated with the pair of separation cylinders in a card.

Figure 1:
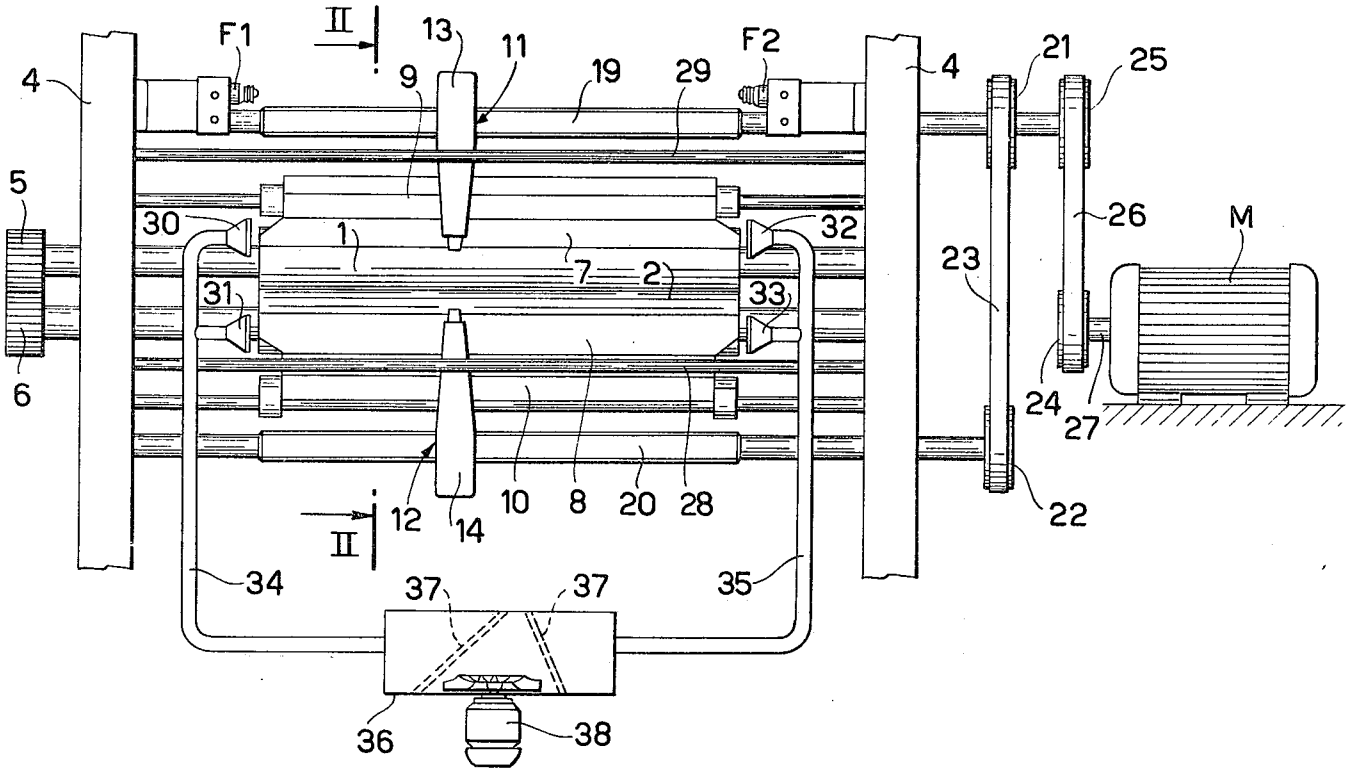
FIG. 1 is a front view of the cleaning device.
Figure 2:
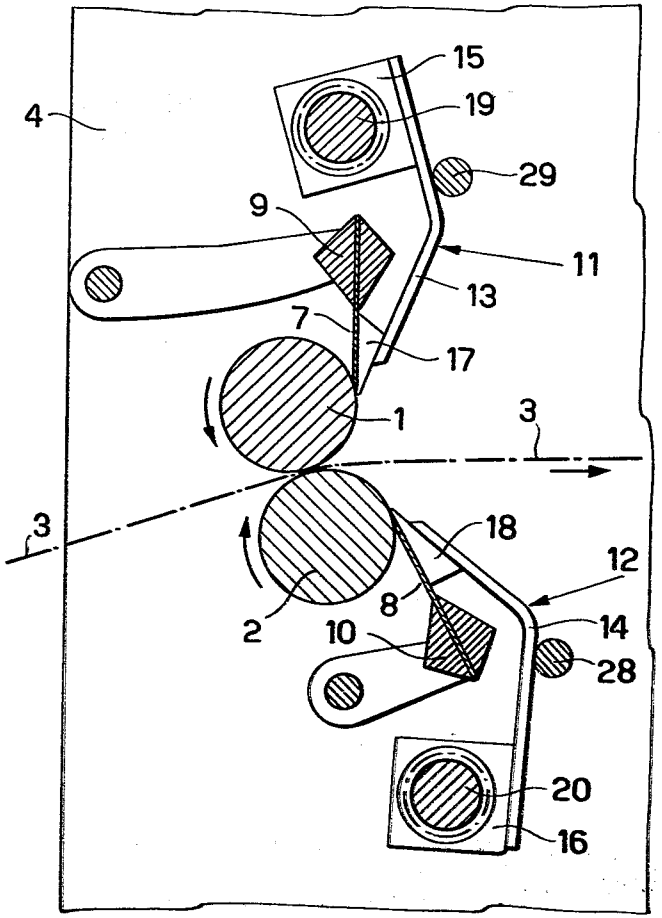
FIG. 2 is a vertical section on the line II—II of FIG. 1.

FIGS. 1 and 2 show the pair of separation cylinders 1, 2 which rotate in opposite directions (as indicated by the arrows in FIG. 2) and between which the web 3 passes, this latter being only diagrammatically indicated by a dashed and dotted line.

The rollers 1, 2 are supported in a frame 4, and are coupled together at one of their ends by a pair of gear wheels 5, 6.

The frame 4 may form part of the card, and the pair of cylinders 1, 2 which are driven by the main machine drive (not shown in the Figures) and are subjected in known manner to a determined pressure, separate the web 3 from the unloading cylinder in accordance with the known art.

A scraper blade 7, 8 respectively is kept in contact with the surface of each cylinder 1, 2, said blades being mounted on respective supports 9, 10 connected to the frame 4.

All the members described up to this point are known to the art, and a more detailed description thereof is therefore unnecessary.

It is however evident that the scraper blades 7, 8 which extend over the entire length of the rollers 1, 2 and are suitably elastically pushed against the respective rollers, keep their surfaces free from impurities and/or fibres, which are transferred to the outer surfaces of the blades.

The device according to the invention is provided to keep the surfaces of the blades 7, 8 clean, and is described hereinafter in greater detail.

The device in question comprises for each blade 7, 8 a cleaning element indicated overall by 11 and 12 respectively, and designed to move with linear to-and-fro motion along the entire length of the respective blade.

In particular, the cleaning elements 11, 12 each comprise an arm 13, 14 fixed to a base 15, 16 and carrying at its free end a pad 17, 18 of elastomer material. The pads 17, 18, which slide in contact with the outer surfaces of the respective blade 7, 8 (see FIG. 2) constitute the actual cleaning elements.

The bases 15, 16 of the cleaning elements each comprise a nut screw mounted on a worm 19, 20 respectively, rotatably supported in the frame 4. At one end, the shafts of said worms 19, 20 carry pulleys 21, 22 connected by a belt 23, and the shaft of the worm 19 carriers a second pulley 25 connected by a belt 26 to a pulley 24 carried by the shaft 27 of a motor M. The motor M therefore rotates in the same direction the two worms 19, 20 on which the bases 15, 16 of the cleaning elements 11, 12 are mounted. To prevent these elements rotating about themselves, fixed bars 28, 29 are provided, mounted in the frame 4 to keep the elements 11, 12 in position, so that on rotation of the worms 19, 20 the cleaning elements are obliged to move parallel to the axes of the rollers 1, 2 along the scraper blades 7, 8.

Figure 3:
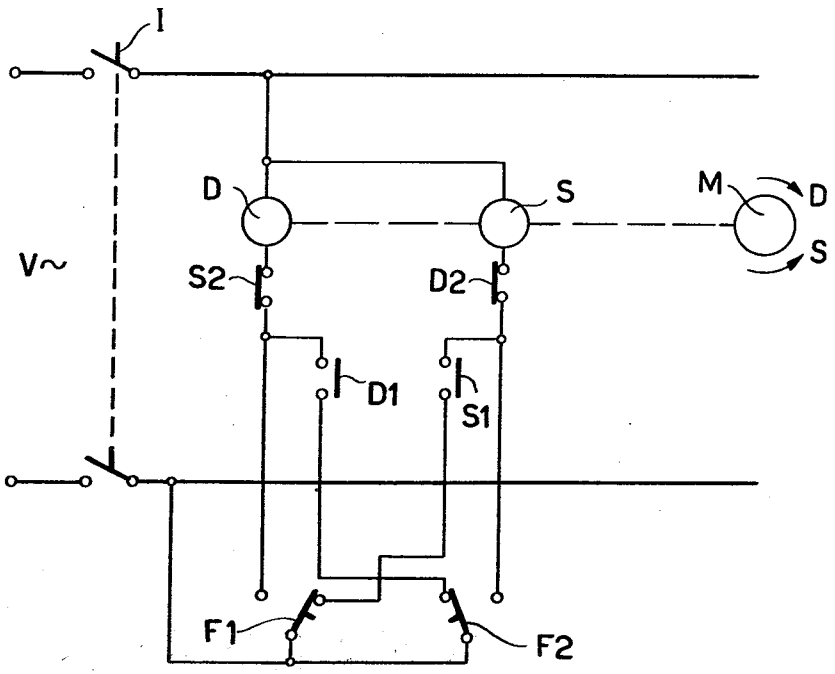
FIG. 3 is an electrical circuit for reversing the movement of the cleaning elements.

At the sides of the worm 19 are disposed two limit switches $F_1$ and $F_2$ connected electrically to the motor M by an electric circuit shown in FIG. 3.

This circuit comprises a main switch I, two remote switches D and S, each with one open contact $D_1$, $S_1$ and one closed contact $D_2$, $S_2$ when de-energised, the two limit switches $F_1$ and $F_2$, and the motor M.

When the remote switches D and S are energised alternately, they drive the motor M with right hand and left hand rotation respectively, so that the cleaning elements 11 and 12 are moved from left to right (with reference to FIG. 1) or from right to left.

If it is assumed that the cleaning elements 11 and 12 are moved entirely to the left so that the element 11 presses against the limit switch $F_1$ (which thus changes position relative to that indicated in FIG. 3), then if the main switch I is closed, the remote switch D is energised and opens its contact $D_2$ so preventing energisation of the remote switch S, and closes its contact $D_1$ which keeps it energised (even when the limit switch $F_1$ is no longer pressed) until the limit switch $F_2$ is pressed.

The remote switch D controlling the right hand rotation of the motor M causes the cleaning elements 11, 12 to move from left to right. When the element 11 presses the limit switch $F_2$ (causing it to change position relative to that indicated in FIG. 3), the remote switch D (which was kept energised by the limit switch $F_2$ in the rest position, with its contact $D_1$ closed and contact $S_2$ also closed) is de-energised and the contacts $D_1$ and $D_2$ return to the rest position.

The remote switch S is energised via the contact $D_2$ so that its contact $S_1$ closes (by self-energisation through the limit switch $F_1$ at rest) and its contact $S_2$ opens to prevent energisation of the remote switch D. The remote switch S causes the motor M to rotate in a left-handed direction and the cleaning elements 11, 12 move from right to left.

With the to-and-fro movement of the cleaning elements 11, 12, their pads 17, 18 slide along the surfaces of the blades 7, 8 to remove the impurities and/or fibres therefrom by displacing them respectively towards the right or the left according to their movement.

In front of the ends of the rollers 1, 2 and blades 7, 8 there are disposed suction ports 30, 31 and 32, 33 respectively, which are connected via tubes 34, 35 to a box 36 in which filters 37 and a motor driven suction fan 38 are mounted. In this manner, the impurities and/or fibres removed from the blades 7, 8 by the cleaning elements 11, 12 collect in said filter box 36 from which they may be periodically removed.

If the machine to which the cleaning device according to the invention is applied is already provided with a suction system, the suction ports 30, 31, 32, 33 may be connected to said system and separate suction means (box 36 and suction fan 38) are therefore unnecessary. Furthermore, the rotational movement of the worms 19, 20, instead of being produced by their own motor M, may be obtained from any moving member of the machine, providing suitable means are provided for reversing the motion each time the cleaning elements reach the right and left limits.

What we claim is:

1. A cleaning device for the scraper blades associated with rotating separation and/or clearing rollers for a web in a spinning machine, such as a card or the like, comprising for each blade a cleaning element resting on the blade, control means to cause each of said cleaning elements to continuously reciprocate from one end of its respective blade to the other, said cleaning elements being in sliding contact with the blades over their entire length, and suction means for cleaning said cleaning element being disposed in spaced relation to the ends of said rollers and said blades.

2. A device as claimed in claim 1, wherein each cleaning element comprises an arm carrying a pad of elastomer material in contact with the respective blade.

3. A device as claimed in claim 1 wherein: said means for controlling movement of the cleaning elements being defined by worm gear means being driven to rotate in one direction and in the opposite direction, said worm gear means being supported with their axes parallel to the axes of the rollers with which the blades to be cleaned are associated, the cleaning elements being coupled to said worm gear means by screw threaded nut means, and means are provided for preventing the cleaning elements from rotating about the axis of said worm gear means.

4. A device as claimed in claim 3, wherein: said means for preventing the cleaning elements from rotating about the axis of said worm gear means being fixed bars against which said cleaning elements slide for maintaining the free ends of said elements on the respective blades.

5. A device as claimed in claim 3, wherein: said control means being provided with limit contacts of switch means with which the cleaning elements come into contact for controlling the direction said worm gears means are driven by drive means.

* * * * *